United States Patent [19]

Nakatani et al.

[11] Patent Number: 4,524,118

[45] Date of Patent: Jun. 18, 1985

[54] ELECTROPHOTOGRAPHIC PHOTOSENSITIVE MATERIAL WITH OZONE INHIBITOR

[75] Inventors: Kaname Nakatani, Kawasaki; Nobuhiro Miyakawa, Abiko; Teruaki Higashiguchi, Tokyo; Tomomi Edo, Osaka, all of Japan

[73] Assignee: Mita Industrial Co., Ltd., Osaka, Japan

[21] Appl. No.: 505,253

[22] Filed: Jun. 17, 1983

[30] Foreign Application Priority Data

Jun. 25, 1982 [JP] Japan ..... 57-108525

[51] Int. Cl.[3] ..... G03G 5/04

[52] U.S. Cl. ..... 430/56; 430/83; 430/89; 430/96; 430/900

[58] Field of Search ..... 430/56, 83, 89, 96, 430/900

[56] References Cited

FOREIGN PATENT DOCUMENTS 49-16501 4/1974 Japan ..... 430/83

1337228 11/1973 United Kingdom ..... 430/58

*Primary Examiner*—Roland E. Martin

*Attorney, Agent, or Firm*—Wenderoth, Lind & Ponack

[57] ABSTRACT

Electrophotographic photosensitive material comprising an electroconductive substrate and a layer of a photoconductive composition composed of a dispersion of a charge generating pigment in a charge transporting medium, which is formed on the electroconductive substrate, wherein said photoconductive composition contains an N,N-di-substituted-carbamic acid salt in an amount of 20 to 200% by weight based on the charge generating pigment. This electrophotographic electrophotosensitive material has excellent ozone resistance and shows a high initial charge retention ratio and sensitivity retention ratio when the cycle of charging and light exposure is repeated many times.

5 Claims, 2 Drawing Figures

INITIAL CHARGE VOLTAGE RETENTION RATIO OF SAMPLE [I]
INITIAL CHARGE VOLTAGE RETENTION RATIO OF SAMPLE [VI]
LIGHT SENSITIVITY RETENTION RATIO OF SAMPLE [I]
LIGHT SENSITIVITY RETENTION RATIO OF SAMPLE [VI]
RETENTION RATIO (%)
100
50
2000 4000 6000 8000 10000 12000
FREQUENCY OF OZONE EXPOSURE (TIMES)

ELECTROPHOTOGRAPHIC PHOTOSENSITIVE MATERIAL WITH OZONE INHIBITOR

BACKGROUND OF THE INVENTION (1) Field of the Invention

The present invention relates to an electrophotographic photosensitive material. More particularly, the present invention relates to an electrophotographic photosensitive material having good ozone resistance, which has excellent initial charge voltage and sensitivity retaining properties when the cycle of charging and light exposure is repeated.

(2) Description of the Prior Art

A photosensitive material comprising an electroconductive substrate and a layer of a photoconductive composition composed of a dispersion of a charge generating pigment (CG) in a charge transporting medium (CT), which is formed on the electroconductive substrate, is used as an electrophotographic photosensitive material having high sensitivity. However, this photosensitive material is defective in that when the reproduction cycle of charging, light exposure, development and toner transfer is repeated, the initial charge voltage and sensitivity are reduced with a relatively small repetition frequency and the life of this material is considerably shorter than that of a selenium photosensitive plate. The reason is considered to be that ozone generated at the charging step or light-excited oxygen generated at the light exposure step attacks the charge generating pigment or medium resin of the photosensitive layer to deteriorate the photosensitive layer.

As means for preventing this deterioration of the photosensitive layer, there has been adopted a method in which a resin having a certain resistance against the attack of oxygen or the like is selected and used for the photosensitive layer. This method, however, is still insufficient in the life of the photosensitive layer, that is, the printing resistance.

SUMMARY OF THE INVENTION

We found that when an N,N-di-substituted-dithiocarbamic acid salt is incorporated in a photosensitive layer of the above-mentioned CG-CT dispersion type, even if charging and light exposure are repeated, the initial charge voltage retention ratio and sensitivity retaining ratio are highly improved. Also the printing resistance is prominently enhanced while electrophotographic characteristics such as the initial charge voltage and sensitivity are not adversely influenced by incorporation of this salt.

More specifically, in accordance with the present invention, there is provided an electrophotographic photosensitive material comprising an electroconductive substrate and a layer of a photoconductive composition composed of a dispersion of a charge generating pigment (CG) in a charge transporting medium (CG), which is formed on the electroconductive substrate, wherein said photoconductive composition contains an N,N-di-substituted-carbamic acid salt in an amount of 20 to 200% by weight based on the charge generating pigment.

DETAILED DESCRIPTION OF THE INVENTION

Figure 1:
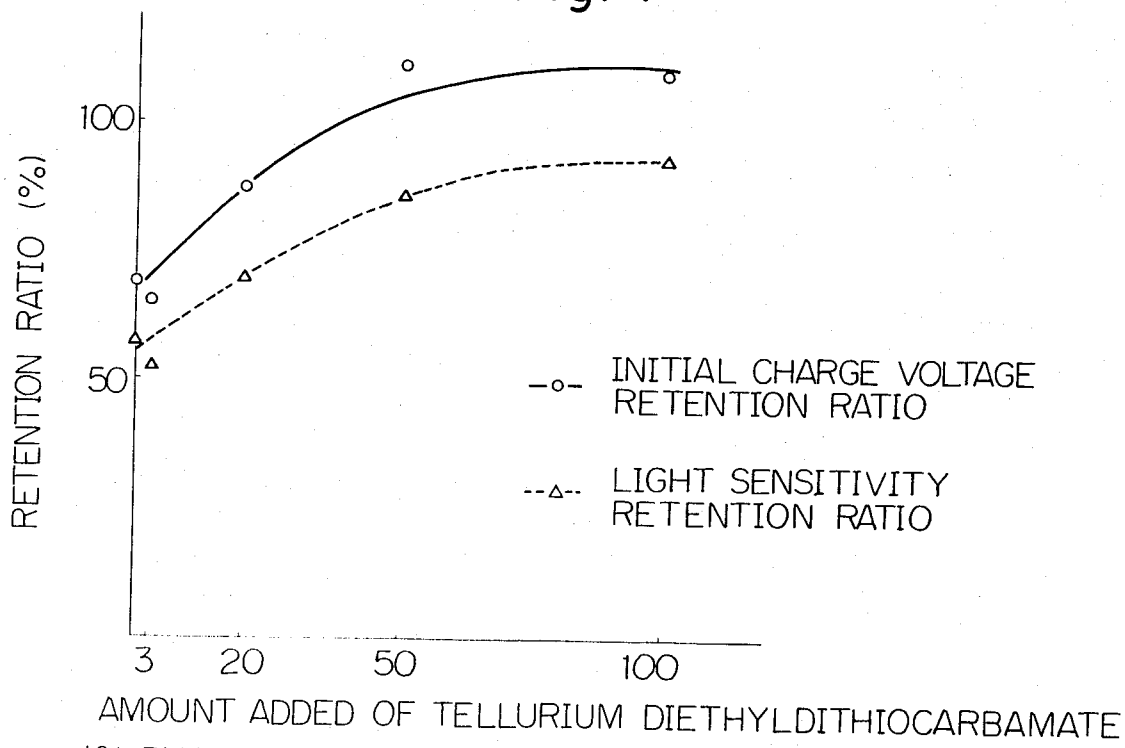
FIG. 1 is a curve showing the influence of the amount of tellurium diethyldithiocarbamate on the initial charge voltage retention ratio and light sensitivity retention ratio.

It is known that a metal salt of an N,N-di-substituted-dithiocarbamic acid has an excellent sensitizing effect for a photoconductive pigment (see Japanese Patent Publication No. 16501/74). When this metal salt is used as the sensitizer, the intended sensitizing effect can be attained if the metal salt is used in an amount of 0.05 to 1% by weight based on the photoconductor, and if the amount of the metal salt is larger than 1% by weight based on the photoconductor, the sensitizing effect is rather reduced. In contrast, in the present invention, by using the above-mentioned salt in a much larger amount, that is, 20 to 200% by weight, especially 50 to 100% by weight, based on the charge generating pigment, the ozone resistance and printing resistance are prominently improved. Accordingly, the present invention is conspicuously different from the above-mentioned conventional technique in the amount of the N,N-di-substituted-dithiocarbamic acid salt and the functional effect attained by incorporation of this salt.

In the present invention, it is important that the N,N-di-substituted-dithiocarbamic acid salt should be used in an amount of 20 to 200% by weight, especially 50 to 100% by weight, based on the charge generating pigment. As shown in Examples given hereinafter, if the amount of the above salt is smaller than the lower limit, the initial charge voltage and sensitivity retention ratios are not substantially improved at the repetition of charging and light exposure over those attained when the salt is not added. If the above salt is added in an amount exceeding the upper limit of the above range, the absolute values of the initial charge voltage and sensitivity tend to decrease.

The reason why the N,N-di-substituted-dithiocarbamic acid salt effectively protects the charge generating pigment or resin medium from the attack of ozone or excited oxygen has not completely been elucidated. However, we believe that this protecting effect is attained according to the following mechanism.

The N,N-di-substituted-dithiocarbamic acid salt has a divalent sulfide group and acts as an electron donor. Ozone or light-excited oxygen (oxygen of the singlet state) attacks the pigment or resin in the portion having a high electron density and acts as a kind of cationic reagent. Accordingly, if the N,N-di-substituted-dithiocarbamic acid salt is incorporated in the above-mentioned composition for the photosensitive layer, transfer of electrons is caused between this salt and ozone or light-excited oxygen, and a kind of charge transfer complex is formed and ozone or active oxygen is thus caught. It is considered that this presumption coincides with the fact that if a considerably large amount of an N,N-di-substituted-dithiocarbamic acid salt is incorporated in the photosensitive layer, the ozone resistance and printing resistance can be improved.

Ordinarily, the N,N-di-substituted-dithiocarbamic acid salt is represented by the following general formula:

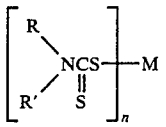

(1)

wherein

R and R′ each stand for an alkyl group or an aryl group,

M stands for a metal atom or an organic base, and n is a number equal to the valence of M.

In the above general formula (1), methyl, ethyl and n-butyl groups can be mentioned as examples of the alkyl group, and a phenyl group can be mentioned as the aryl group. As the metal M, there can be mentioned metals of the group Ia of the Periodic Table such as sodium and potassium, metals of the group Ib of the Periodic Table such as copper, metals of the group IIa of the Periodic Table such as calcium, barium and strontium, metals of the group IIb of the Periodic Table such as zinc, cadmium and mercury, metals of the group IVa of the Periodic Table such as tin and lead, metals of the group Va of the Periodic Table such as bismuth, metals of the group VI of the Periodic Table such as selenium and tellurium, and metals of the group VIII of the Periodic Table such as iron, cobalt and nickel. As the organic base, there can be mentioned pipecoline and piperidine. In the general formula (1), it is preferred that the number of carbon atoms in the alkyl group be up to 5.

As preferred examples of the N,N-di-substituted-dithiocarbamic acid salt, there can be mentioned zinc dimethyldithiocarbamate, zinc diethyldithiocarbamate, zinc dibutyldithiocarbamate, zinc ethylphenyldithiocarbamate, sodium dimethyldithiocarbamate, sodium diethyldithiocarbamate, sodium dibutyldithiocarbamate, copper dimethyldithiocarbamate, cadmium diethyldithiocarbamate, iron (III) dimethyldithiocarbamate, lead dimethyldithiocarbamate, selenium dimethyldithiocarbamate, selenium diethyldithiocarbamate, tellurium diethyldithiocarbamate, bismuth dimethyldithiocarbamate, pipecoline dimethyldithiocarbamate and piperidine dimethyldithiocarbamate. Tellurium dialkyldithiocarbamates are especially suitable for attaining the object of the present invention.

Any of known organic and inorganic photoconductive pigments can be used as the charge generating pigment in the present invention. However, use of photoconductive organic pigments such as phthalocyanine pigments, perylene pigments, pyranthrone pigments, qunicaridone pigments, disazo pigments and trisazo pigments is preferred. These pigments may be used singly or in the form of mixtures of two or more of them. When the present invention is applied to a photoconductive organic pigment having a low ozone fastness, such as a disazo pigment or a trisazo pigment, an especially prominent effect can be attained.

In the present invention, any of known hole transporting substances and electron transporting substances can be used as the charge transporting substance. As preferred examples of the hole transporting substance, there can be mentioned poly-N-vinylcarbazole, phenanthrene, N-ethylcarbazole, 2,5-diphenyl-1,3,4-oxadiazole, 2,5-bis-(4-diethylaminophenyl)-1,3,4-oxadiazole, bis-diethylaminophenyl-1,3,6-oxadiazole, 4,4′-bis(diethylamino)-2,2′-dimethyltriphenylmethane, 2,4,5-triaminophenylimidazole, 2,5-bis(4-diethylaminophenyl)-1,3,4-triazole, 1-phenyl-3-(4-diethylaminostyryl)-5-(4-diethylaminophenyl)-2-pyrazoline and p-diethylaminobenzaldehydo-(diphenylhydrazone). As preferred examples of the electron transporting substance, there can be mentioned 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxanthone, dinitroanthracene, dinitroacrydine and dinitroanthraquinone. These charge transporting substances may be used singly or in the form of a mixture of two or more of them. Of course, if a complex of an electron acceptor and an electron donor is used as the charge transporting substance, both holes and electrons can be transported.

When the charge transporting substance is a low-molecular-weight substance, it is necessary that the charge transporting substance should be dispersed in a binder resin described below, and the resulting dispersion should be used as the charge transporting medium. Furthermore, even if the charge transporting substance is a high-molecular-weight substance having a binding property, in order to reinforce the mechanical properties and increase the adhesion, it is preferred that a binder resin be used.

Any of known binder resins can be used in the present invention. As preferred examples, there can be mentioned a polyester resin, an acrylic resin, a styrene resin, an epoxy resin, a silicon resin, an alkyd resin and a vinyl chloride-vinyl acetate copolymer.

It is preferred that the charge transporting medium be used in an amount of 0.5 to 20 parts by weight, especially 1 to 10 parts by weight, per part by weight of the charge generating pigment.

A photoconductive composition especially suitable for attaining the object of the present invention comprises 1 part by weight of a charge generating pigment, 0.5 to 20 parts by weight of a charge transporting substance, 1 to 20 parts by weight of a binder resin and 0.2 to 2 parts by weight of a compound represented by the general formula (1). At least one member selected from known additives such as a viscosity bodying agent, a viscosity reducing agent, a sagging preventing agent, a levelling agent, a defoamer, a dye sensitizing agent and a chemical sensitizing agent may be incorporated into the above-mentioned composition.

As the electroconductive substrate, there may be used a plate, sheet or drum of copper, aluminum, silver, tin, iron or the like, or a structure formed by depositing a thin film of the above-mentioned metal on a plastic film or the like by vacuum deposition or nonelectrolytic plating.

The photoconductive composition of the present invention can be applied to the electroconductive substrate in the form of a layer having a thickness of 2 to 20μ, especially 3 to 10μ, as solids.

The N,N-di-substituted-dithiocarbamic acid salt that is used in the present invention has good compatibility with the binder resin for formation of the photoconductive layer, and also has good solubility in an organic solvent for formation of a coating composition for use in preparing the photoconductive layer.

The photosensitive material may be formed, for example, according to a method in which the charge transporting substance, binder and N,N-di-substituted-dithiocarbamic acid salt are dissolved in an appropriate solvent, the charge generating pigment in the solution to form a coating composition, and the composition is coated on the electroconductive substrate so that a layer having the above-mentioned thickness is formed.

As the organic solvent for formation of the coating composition, there can be mentioned aromatic hydrocarbon solvents such as benzene, toluene and xylene, cyclic ethers such as dioxane and tetrahydrofuran, ketones such as methylethyl ketone, methylisobutyl ketone and cyclohexanone, alcohols such as diacetone alcohol, ethylene glycol and isobutyl ether, and alicyclic hydrocarbons such as cyclohexane. These organic solvents may be used singly or in the form of a mixture of two or more of them.

The photosensitive material is especially effectively used as an electrophotographic photosensitive material of the negative charging type in which generation of ozone is prominent and the influences of ozone are very serious, and in this case, the printing resistance can remarkably be improved. Of course, the photosensitive material of the present invention can be used as an electrophotoconductive photosensitive material of the positive charging type, and also in this case, the printing resistance can prominently be improved.

The present invention will now be described in detail with reference to the following Examples that by no means limit the scope of the invention.

EXAMPLE 1

A photosensitive layer of the charge generating pigment/charge transporting substance/resin dispersion type to which a compound of the formula (1) was added, and a photosensitive layer of the same type to which a compound of the formula (1) was not added were exposed to ozone, and the initial charge voltages before and after the ozone exposure and the light half-decay times (t) were measured.

At first, a coating composition was prepared according to the following recipe:

| | |
|---|---|
| Dian Blue | 1 part by weight |
| p-Diethylaminobenzaldehydo-(diphenylhydrazone) | 7 parts by weight |
| Polyester resin (Vylon 200 supplied by Toyobo) | 10 parts by weight |
| Tetrahydrofuran | 100 parts by weight |

The so-formed composition was designated as "sample [I]". Samples [II] and [III] were prepared by adding to the sample [I] 0.2 part by weight of tellurium diethyldithiocarbamate and 0.2 part by weight of zinc diethyldithiocarbamate, respectively. Each sample was dispersed in a ball mill for 5 hours, and the resulting dispersion was coated on an aluminum plate having a thickness of 50 μm by a wire bar and dried at 80° C. for 1 hour to obtain an electrophotographic photosensitive material having a coating layer thickness of about 8 μm.

By using an electrophotographic photosensitive material tester (Model SP-428 supplied by Kawaguchi Denki), each sample was subjected to corona discharge at −6 KV under conditions of Static II, and to light exposure so that the illuminance of the surface of the photosensitive material was 40 luxes. The initial charge voltage (Vo) and the light half-decay time (to) were measured to obtain data before the ozone exposure.

The ozone exposure was carried out by attaching the sample of the photosensitive material to an aluminum pipe drum of a PPC copying machine (Model DC-15 supplied by Mita Industrial Co., Ltd.) and repeating 2000 times the cycle of negative charging→entire surface light exposure→negative charging→charge removal (by light exposure and alternating current corona discharge). Then, the initial charge voltage (Vl) and light half-decay time (tl) were measured in the same manner as described above. The degree of deterioration by the ozone exposure was examined based on the initial charge voltage retention ratio (Vl/Vo, %) and the ratio (to/tl, %) of retention of the reciprocal of the light half-decay time.

The obtained results are shown in the Table, from which it will readily be understood that the ozone resistance of a photosensitive material can be improved by incorporation of an N,N-di-substituted-dithiocarbamic acid salt.

TABLE

| Photosensitive Material | Initial Charge Voltage (V) | | | Light Half-Decay Time (seconds) | | |
|---|---|---|---|---|---|---|
| | Vo | Vl | Vl/Vo (%) | to | tl | to/tl (%) |
| sample [I] | 357 | 250 | 70 | 1.00 | 2.00 | 50 |
| sample [II] | 298 | 343 | 115 | 1.25 | 1.40 | 89 |
| sample [III] | 334 | 267 | 79 | 0.95 | 1.60 | 60 |

EXAMPLE 2

Tellurium diethyldithiocarbamate was added in amounts of 0.03 part by weight, 0.2 part by weight, 0.5 part by weight and 1 part by weight independently to the sample [I] described in Example 1 to obtain samples [IV], [V], [VI] and [VII], respectively. Photosensitive materials were prepared from the samples [I] and [IV] through [VII] in the same manner as described in Example 1. The ozone exposure was carried out in the same manner as described in Example 1, and the electrophotographic characteristics were determined as in Example 1.

FIG. 1 shows the influence of the amount of tellurium diethyldithiocarbamate on the initial charge voltage retention ratio and light sensitivity (reciprocal of the light half-decay time) retention ratio, which were observed in this Example. From FIG. 1, it is seen that when the amount added is 50%, the effect becomes saturated, and even if the amount added exceeds 50%, the effect is not changed.

EXAMPLE 3

In a photosensitive material to which a compound of the formula (1) was added and a photosensitive material to which this compound was not added, changes of the initial charge retention ratio and the light sensitivity (reciprocal of the light half-decay time) retention ratio were examined while the ozone exposure time was changed.

Samples [I] and [VI] were prepared in the same manner as described in Examples 1 and 2, and electrophotographic photosensitive materials were prepared by using these samples in the same manner as in Example 1. These photosensitive materials were subjected to the ozone exposure 2000 times, 4000 times, 6000 times, 8000 times, 10000 times or 12000 times in the same manner as described in Example 1. The measurement of the electrophotographic characteristics was carried out in each case in the same manner as described in Example 1. One sheet of the sample [I] and one sheet of the sample [VI] were used for each run.

Figure 2:
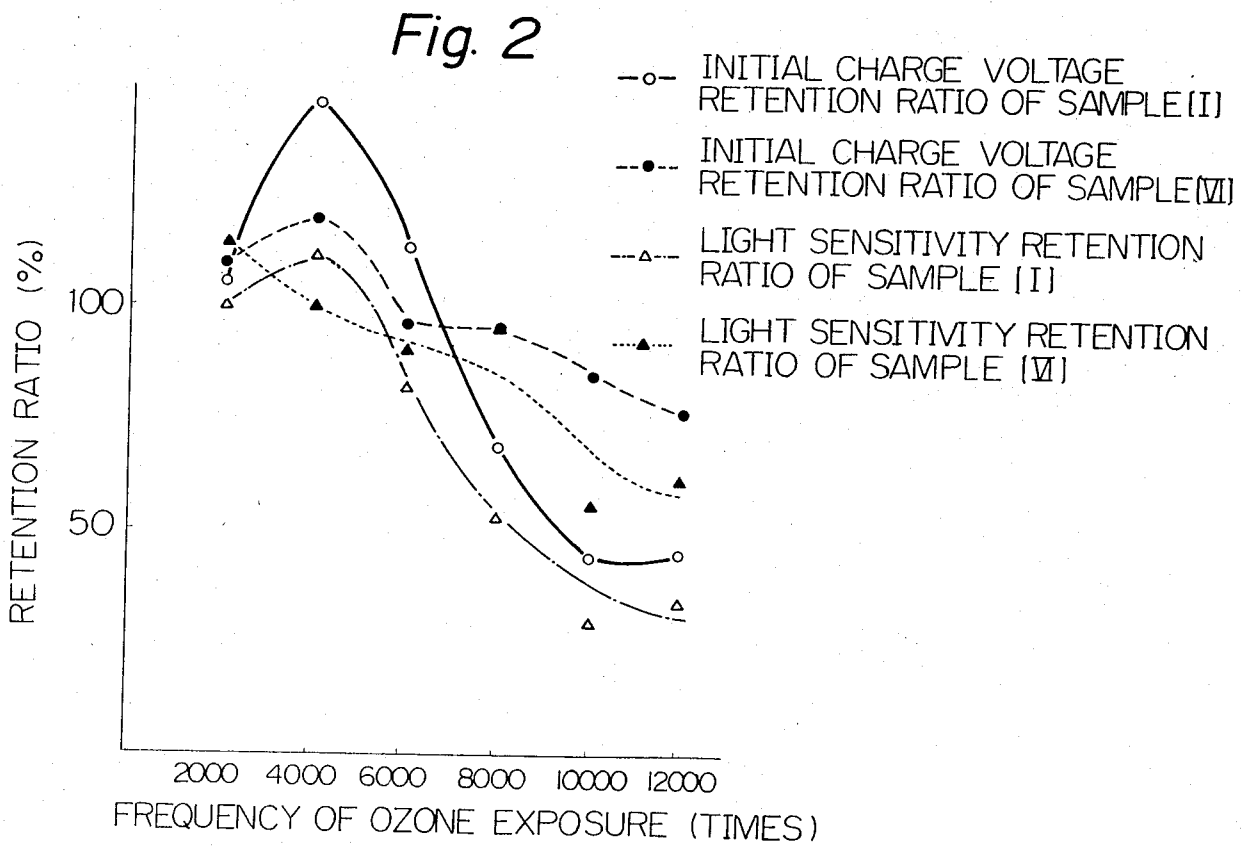
FIG. 2 is a curve showing influences of the frequency of the ozone exposure on the initial charge voltage retention ratio and light sensitivity retention ratio in a photosensitive material to which tellurium diethyldithiocarbamate is added, and in a photosensitive material to which this salt is not added.

FIG. 2 shows the influence of the frequency of the ozone exposure on the initial charge voltage retention ratio and light sensitivity retention ratio, which were observed in the samples [I] and [VI]. From the results shown in FIG. 2, it is seen that by incorporation of an N,N-di-substituted-dithiocarbamic acid salt, the ozone resistance of a photosensitive material is improved and this improving effect is especially prominent when the ozone exposure is repeated 8000 times or more.

What is claimed is:

1. An electrophotographic material comprising an electroconductive substrate and formed thereon a layer of a photoconductive composition containing a dispersion of an organic pigment as a charge generating pigment in a charge transporting medium, said photoconductive composition comprising 0.5 to 20% by weight of at least one charge transporting substance selected from the group consisting of hole transporting substances and electron transporting substances, 1 to 20% by weight of a binder resin, and as an ozone resistance improver 50 to 100% by weight of an N,N-di-substituted-dithiocarbamic acid salt of the formula

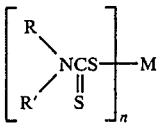

wherein

R and R' each is an alkyl or aryl group,

M is a metal atom or an organic base, and n is a number equal to the valence of M, all amounts being based on the weight of said charge generating pigment.

2. An electrophotographic material as set forth in claim 1, wherein the N,N-di-substituted-dithiocarbamic acid salt is a member selected from the group consisting of zinc dimethyldithiocarbamate, zinc diethyldithiocarbamate, zinc dibutyldithiocarbamate, zinc ethylphenyldithiocarbamate, sodium dimethyldithiocarbamate, sodium diethyldithiocarbamate, sodium dibutyldithiocarbamate, copper dimethyldithiocarbamate, cadmium diethyldithiocarbamate, iron (III) dimethyldithiocarbamate, lead dimethyldithiocarbamate, selenium dimethyldithiocarbamate, selenium diethyldithiocarbamate, tellurium diethyldithiocarbamate, bismuth dimethyldithiocarbamate, pipecoline dimethyldithiocarbamate and piperidine dimethyldithiocarbamate.

3. An electrophotographic material as set forth in claim 1, wherein the N,N-disubstituted-dithiocarbamic acid salt is a tellurium dialkyldithiocarbamate.

4. An electrophotographic material as set forth in claim 1, wherein the charge generating pigment is a disazo pigment or a trisazo pigment.

5. An electrophotographic material as set forth in claim 1, wherein the thickness of the layer of the photoconductive composition is 2 to 20μ as solids.

* * * * *